US006314748B1

(12) United States Patent
Zhu et al.

(10) Patent No.: US 6,314,748 B1
(45) Date of Patent: Nov. 13, 2001

(54) WINDOW-TYPE OF INTEGRATED AIR-CONDITIONER

(75) Inventors: Jianghong Zhu; Jianmin Chen; Yanbin Liu, all of Guangdong (CN)

(73) Assignee: Gree Electric Appliances Inc. of Zhuhai, Guangdong (CN)

( * ) Notice: Subject to any disclaimer, the term of this patent is extended or adjusted under 35 U.S.C. 154(b) by 0 days.

(21) Appl. No.: 09/413,390

(22) Filed: Oct. 6, 1999

(30) Foreign Application Priority Data

Oct. 7, 1998 (CN) ..... 98243121

(51) Int. Cl.[7] ..... F25D 23/12
(52) U.S. Cl. ..... 62/263; 62/428
(58) Field of Search ..... 62/262, 263, 429, 62/428

(56) References Cited

U.S. PATENT DOCUMENTS 2,486,828 * 11/1949 Dybvig ..... 62/262
2,660,867 * 12/1953 Borgerd ..... 62/262
3,404,539 * 10/1968 Laing ..... 62/263
4,854,375 * 8/1989 Farina et al. ..... 62/263
5,388,426 * 2/1995 Wada et al. ..... 62/263
5,600,963 * 2/1997 Koo et al. ..... 62/262
5,669,229 * 9/1997 Ohbayashi et al. ..... 62/262

FOREIGN PATENT DOCUMENTS 95204170.7 6/1996 (CN) .
95206056.6 11/1996 (CN) .

* cited by examiner

*Primary Examiner*—William E. Tapolcai
(74) *Attorney, Agent, or Firm*—Jenkens & Gilchrist, a Professional Corporation

(57) ABSTRACT

A window-type of integrated air-conditioner is mainly characterized in that the assembly of evaporator is composed of several sections of the evaporator connected from the beginning to the end and is arranged in a folded form, its condensers are two sets, to see from the top, they are arranged in a V shape, the intersecting point of the two sets of the condensers is towards the inside of the room, using the present invention has the advantages of higher heat-exchanging efficiency, low noise, well-distribution of heat exchange and marked increase of energy-to-efficiency ratio, etc., such as a window-type of air-conditioner with the refrigerating capacity 2500 W, after this structure is used, its noise can be reduced to 45 dB(A), the energy-to-efficiency ratio can reach 2.5 W/W so as to effectively overcome the deficiencies of the prior art, it is a more ideal new window-type of air-conditioner.

12 Claims, 2 Drawing Sheets

WINDOW-TYPE OF INTEGRATED AIR-CONDITIONER

The present invention relates to a window-type of integrated air-conditioner, specifically, to a window-type of air-conditioner for fulfilling the object of high efficiency and low noise through the improvement of its evaporator and condensers.

At present, there are many kinds of air-conditioners, but generally they are divided into two main kinds—window-type of air-conditioners and split-type of air-conditioners. In the window-type of air-conditioner, the vertical plate-type design is usually used for the evaporator, and a centrifugal fan is used, and the wind-blowing-type arrangement is generally used for its condenser and the vertical plate-type design is also used. Though this structure can fulfill the object of adjusting the air in a room, because the dimensions of the plates of the prior window-type air-conditioner facing the inside and outside of the room are limited, the heat-exchanging dimensions of the above evaporator and condensers are limited to some extent, in order that the heat-exchanging results of the evaporator and condensers fulfill the requirements for design, usually it is fulfilled by increasing the rotating speed of the fan, but the increase of the rotating speed causes the increase of the noise. Therefore usually the deficiencies of lower heat-exchanging efficiency, relatively more noise, poor-distribution of heat exchange, and lower energy-to-efficiency ratio, etc. exist in the present window-type air-conditioner.

An object of the present invention is to provide a window-type integrated air-conditioner for effectively improving the heat-exchanging results of the evaporator by means of a multi-section-type evaporator arranged according to a folded form and improve the heat-exchanging efficiency of the condensers by means of multiple sets of wind-inhaling-type condensers to make it have the advantages of higher heat-exchanging efficiency, low noise, well-distribution of heat exchange and marked increase of energy-to-efficiency ratio, etc. so as to effectively overcome the deficiencies of the prior art.

The object of the present invention is fulfilled through the following mode: a window-type of integrated air-conditioner mainly comprises a compressor, a cross-flow fan, an evaporator, a worm casing, a worm tongue, an outer housing, a face housing, a wind inlet, a wind outlet, condensers and an axial blow fan, characterized in that the assembly of evaporator is composed of several sections of the evaporator connected from the beginning to the end and is arranged in a folded form.

It is characterized in that the assembly of evaporator comprises three sections of the evaporator.

It is also characterized in that said condensers are of two sets, to see from the top, they are arranged in a V shape, the intersecting point of the two sets of the condensers is towards the inside of the room.

In a specific embodiment, the size of the plates of the above evaporators and the intersection angle between them can be adjusted according to the specifications and overall dimensions of the window-type of air-conditioner, and the size of the plates of the condensers and the intersection angle between them can also be adjusted according to the specifications and overall dimensions of the window-type of air-conditioner. The dimensions can be selected within the following range: The length dimension L1 of said evaporator in the direction of a folded line is 86–106 mm and the intersection angle $\alpha 1$ to the horizontal plane is 25–45 degrees, the length dimension L2 of the evaporator in the direction of a folded line is 104–124 mm and the intersection angle $\alpha 2$ to the evaporator is 110–130 degrees, the length dimension L3 of the evaporator in the direction of a folded line is 162–182 mm and the intersection angle $\alpha 3$ to the evaporator is 50–70 degrees, the outer diameter of the cross-flow fan is 106–146 mm. The better range is: the length dimension L1 of said evaporator in the direction of a folded line is 91–101 mm and the intersection angle $\alpha 1$ to the horizontal plane is 30–40 degrees, the length dimension L2 of the evaporator in the direction of a folded line is 109–119 mm and the intersection angle $\alpha 2$ to the evaporator is 115–125 degrees, the length dimension L3 of the evaporator in the direction of a folded line is 167–177 mm and the intersection angle $\alpha 3$ to the evaporator is 55–65 degrees, the outer diameter of said cross-flow fan is 116–136 mm. The optimum range is: the length dimension LI of the evaporator in the direction of a folded line is 92.5–98.5 mm and the intersection angle $\alpha 1$ to the horizontal plane is 32.5–37.5 degrees, the length dimension L2 of the evaporator in the direction of a folded line is 111.5–116.5 mm and the intersection angle $\alpha 2$ to the evaporator is 117.5–122.5 degrees, the length dimension L3 of the evaporator in the direction of a folded line is 169.5–174.5 mm and the intersection angle $\alpha 3$ to the evaporator is 57.5–62.5 degrees, the outer diameter of the cross-flow fan is 121–131 mm.

The length L4 of each set of the condensers is 170–370 mm, the intersection angle $\alpha 4$ of the two sets of said condensers is 67–107 degrees. The better range is: the length L4 of each set of said condensers is 245–320 mm, the intersection angle $\alpha 4$ of the two sets of the condensers is 77–97 degrees. The optimum range is: the length L4 of each set of the condensers is 258–295 mm, the intersection angle $\alpha 4$ of the two sets of the condensers is 82–92 degrees.

The vertical distance H1 between the end of said evaporator and the axis of the cross-flow fan is 58–78 mm, the horizontal distance H2 is 38–58 mm, the arc surface of the worm casing is mainly composed of two sections of arc tangent surfaces of radius R1 being 80–120 mm and radius R2 being 110–150 mm, the vertical distance H3 between the origin of radius R1 and the axis of the cross-flow fan is 19–29 mm, the horizontal distance H4 is 9–19 mm, the vertical distance H5 between the origin of radius R2 and the axis of the cross-flow fan is −3–7 mm, the horizontal distance H6 is 29–39 mm, the vertical distance H7 between the origin of the worm tongue and the axis of the cross-flow fan is 46–86 mm, the horizontal distance H8 is 10–50 mm. The better range is: the vertical distance H1 between the end of the evaporator and the axis of the cross-flow fan is 63–73 mm, the horizontal distance H2 is 43–53 mm, the arc surface of the worm casing is mainly composed of two sections of arc tangent surfaces of radius R1 being 90–110 mm and radius R2 being 120–140 mm, the vertical distance H3 between the origin of radius R1 and the axis of the cross-flow fan is 21.5–26.5 mm, the horizontal distance H4 is 11.5–16.5 mm, the vertical distance H5 between the origin of radius R2 and the axis of the cross-flow fan is −0.5–4.5 mm, the horizontal distance H6 is 31.5–36.5 mm, the vertical distance H7 between the origin of the worm tongue and the axis of the cross-flow fan is 56–76 mm, the horizontal distance H8 is 20–40 mm. The optimum range is: the vertical distance Hi between the end of said evaporator and the axis of the cross-flow fan is 65.5–70.5 mm, the horizontal distance H2 is 45.5–50.5 mm, the arc surface of the worm casing is mainly composed of two sections of arc tangent surfaces of radius R1 being 95–105 mm and radius R2 being 125–135 mm, the vertical distance H3 between the origin of radius R1 and the axis of the cross-flow fan is 23–25 mm, the horizontal distance H4 is 13–15 mm, the vertical distance H5 between the origin of radius R2 and the axis of the cross-flow fan is 1–3 mm, the horizontal distance H6 is 33–35 mm, the vertical distance H7 between the origin of the worlml tongue and the axis of the cross-flow fan is 61–71 mm, the vertical distance H8 is 25–35 mm.

In the above technical solution, said wind inlets are arranged in the front and the upper part of the face housing, the wind outlet is arranged in the lower part of the face housing.

Because a multi-section-type evaporator according to a folded form and multiple sets of wind-inhaling-type condensers are used, the highly effective low-noise window-type air-conditioner of the present invention effectively increases the effective heat-exchanging area of the evaporator and the condensers and changes the structure of the heat-exchanging fan and the position of its arrangement so as to effectively increases the heat-exchanging efficiency and the energy-to-efficiency ratio of the air-conditioner without changing the original compressor and the other means, and under the condition of the same amount of the wind going out, it reduces the wind speed so as to make its noise markedly reduced, and it has the advantages of higher heat-exchanging efficiency, low noise, well-distribution of heat exchange and marked increase of the energy-to-efficiency ratio, etc. For example, as for the window-type air-conditioner with the refrigerating capacity being 2500 W, after the structure of the present invention is used, its noise can be reduced to 45 dB (A), its energy-to-efficiency ratio can reach 2.5 W/W so as to effectively overcome the deficiencies of the prior art, so it is a more ideal new window-type of air-conditioner.

Figure 1:
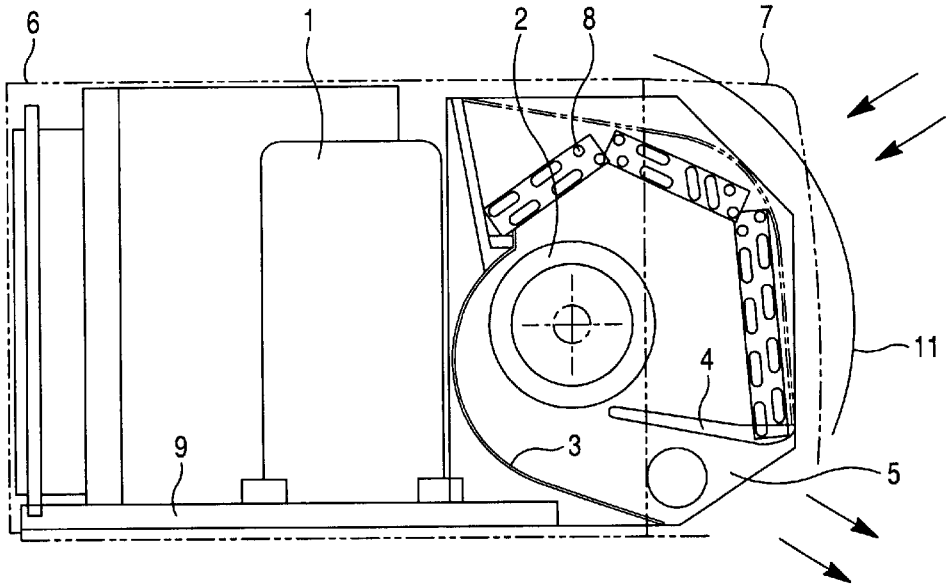
FIG. 1 is a schematic diagram of the side-view structure of an embodiment of the present invention.
Figure 2:
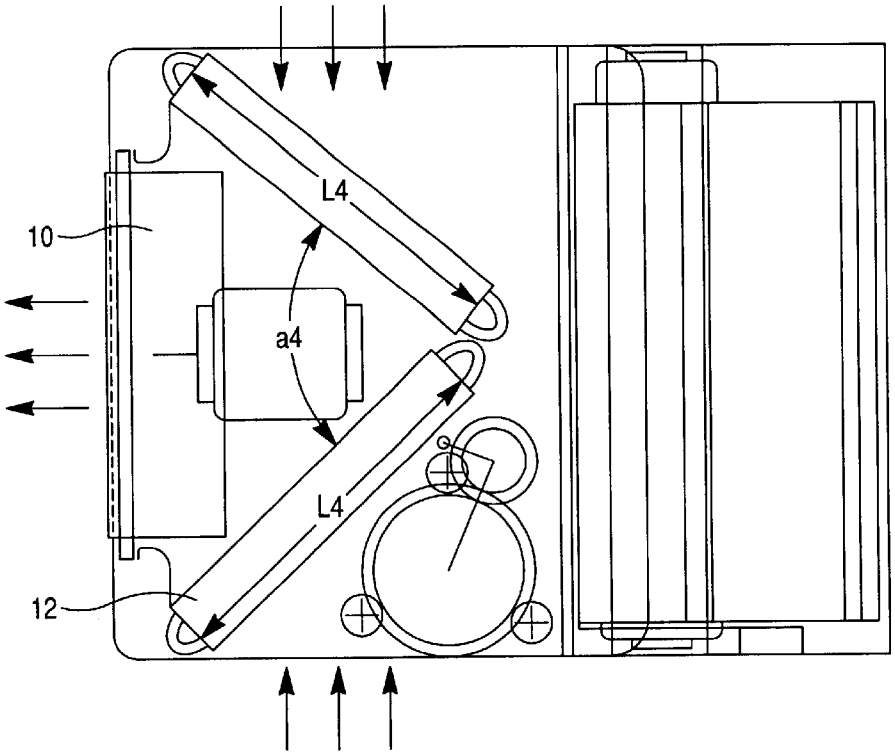
FIG. 2 is a schematic diagram of the top-view structure of the above invention.
Figure 3:
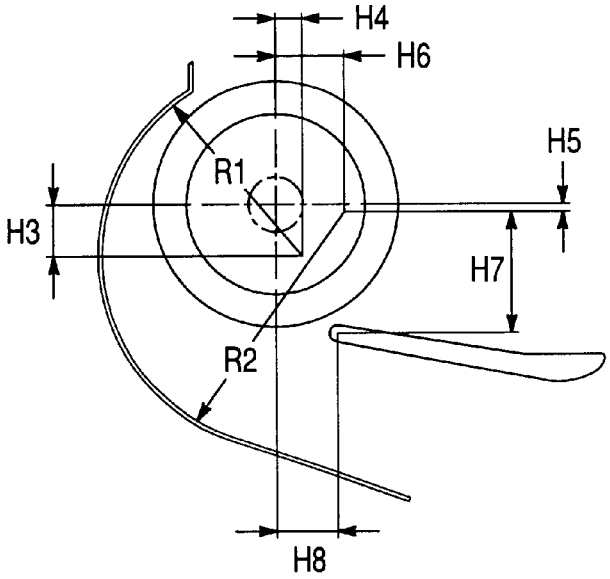
FIG. 3 is a schematic diagram of the size of the structure of the cross-flow fan and the worm casing.
Figure 4:
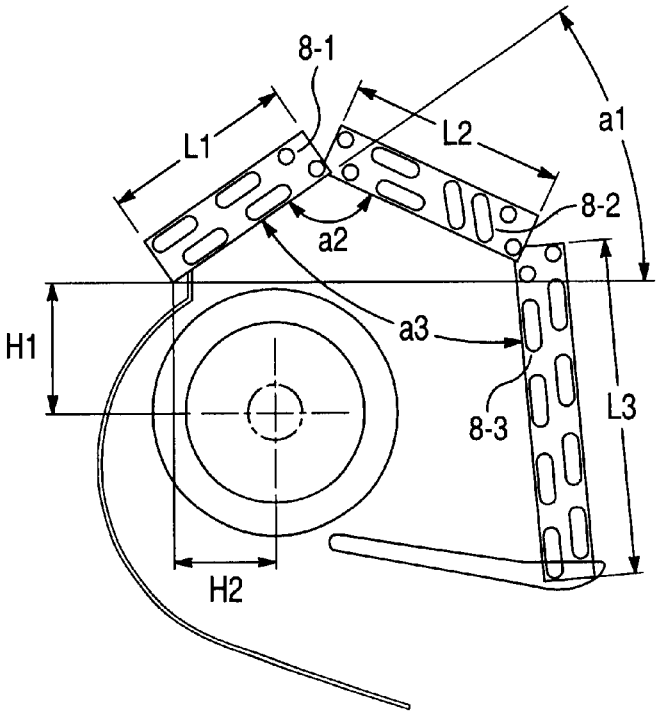
FIG. 4 is a schematic diagram of the structure of an evaporator.

In the drawings, numeral 1 designates a compressor, 2—cross-flow fan, 3—a worm casing, 4—a wonn tongue, 5—a wind outlet , 6—an outer housing, 7—a face housing, 8—an evaporator, 9—a base plate, 10—an axial flow fan, 11—a wind inlet, 12—condensers.

The present invention is further described with reference to the drawings and in conjunction with the embodiments.

As shown in the drawings, the window-type integrated air-conditioner of the present invention mainly comprises a compressor 1, cross-flow fan 2, an evaporator 8, a wonrm casing 3, a wonn tongue 4, an outer housing 6, a face housing 7, a wind inlet 11, a wind outlet 5, condensers 12 and an axial flow fan 10, it is characterized in that the assembly of evaporator 8 is composed of several sections of the evaporator connected from the beginning to the end and is arranged in a folded form.

The assembly of evaporator 8 is composed of three sections, evaporator 8-1, evaporator 8-2 and evaporator 8-3.

The above condensers 12 are of two sets, to see from the top, they are arranged in a V shape, the intersecting point of the two sets of the condensers 12 is towards the inside of the room, the axial flow fan 10 is arranged in the wind outlet of the condensers 12.

EMBODIMENT 1

The length dimension L1 of said evaporator 8-1 in the direction of a folded line is 96 mm and the intersection angle $\alpha 1$ to the horizontal plane is 35 degrees, the length dimension L2 of said evaporator 8-2 in the direction of a folded line is 114 mm and the intersection angle $\alpha 2$ to the evaporator 8-1 is 120 degrees, the length dimension L3 of the evaporator 8-3 in the direction of a folded line is 172 mm and the intersection angle $\alpha 3$ to the evaporator 8-1 is 60 degrees, the outer diameter of the cross-flow fan 2 is 126 mm; the length L4 of each set of the condensers 12 is 275 mm, the intersection angle $\alpha 4$ of the two sets of the condensers is 87 degrees; the vertical distance H1 between the end of the evaporator 8 and the axis of the cross-flow fan 2 is 68 mm, the horizontal distance H2 is 48 mm, the arc surface of the worm casing 3 is mainly composed of two sections of arc tangent surfaces of radius R1 being 100 mm and radius R2 being 135 mm, the vertical distance H3 between the origin of radius R1 and the axis of the cross-flow fan 2 is 24 mm, the horizontal distance H4 is 14 mm, the vertical distance H5 between the origin of radius R2 and the axis of the cross-flow fan 2 is 2 mm, the horizontal distance H6 is 34 mm. The vertical distance H7 between the origin of the worm tongue 4 and the axis of the cross-flow fan 2 is 66 mm, and the horizontal distance H8 is 30 mm.

In the above technical solution, said wind inlet 11 is arranged in the front and the upper part of the face housing 7, and the wind outlet 5 is arranged in the lower part of the face housing 7.

The window-type air-conditioner manufactured according to the above size is detected by using the method prescribed in the state standard GB/T25-1996, its main performance indexes are: the noise is 45 dB (A), the energy-to-efficiency ratio is 2.5 W/W, the refrigerating capacity is 2500 W.

EMBODIMENT 2

The length dimension L1 of the evaporator 8-1 in the direction of a folded line is 106 mm and the intersection angle $\alpha 1$ to the horizontal plane is 45 degrees. The length dimension L2 of the evaporator 8-2 in the direction of a folded line is 124 mm and the intersection angle $\alpha 2$ to the evaporator 8-1 is 130 degrees. The length dimension L3 of the evaporator 8-3 in the direction of a folded line is 187 mm and the intersection angle $\alpha 3$ to said evaporator 8-1 is 70 degrees. The outer diameter of the cross-flow fan 2 is 146 mm; the length L4 of each set of the condensers 12 is 370 mm, the intersection angle $\alpha 4$ of the two sets of the condensers is 107 degrees. The vertical distance H1 between the end of said evaporator 8 and the axis of said cross-flow fan 2 is 78 mm, the horizontal distance H2 is 58 mm, the arc surface of the worm casing 3 is mainly composed of two sections of arc tangent surfaces of radius R1 being 120 mm and radius R2 being 150 mm, the vertical distance H3 between the origin of radius R1 and the axis of the cross-flow fan 2 is 29 mm, the horizontal distance H4 is 19 mm, the vertical distance H5 between the origin of radius R2 and the axis of the cross-flow fan 2 is 7 mm, the horizontal distance H6 is 39 mm. The vertical distance H7 between the origin of the worm tongue 4 and the axis of the cross-flow fan 2 is 86 mm, and the horizontal distance H8 is 50 mm.

In the above technical solution, the wind inlet 11 is arranged in the front and the upper part of the face housing 7, and the wind outlet 5 is arranged in the lower part of the face housing 7.

The window-type air-conditioner manufactured according to the above size is detected by using the method prescribed in the state standard GB/T7725-1996, its main performance indexes are: the noise is ≦48 dB (A), the energy-to-efficiency ratio is 2.35 W/W, the refrigerating capacity is 2800 W.

EMBODIMENT 3

The length dimension L1 of said evaporator 8-1 in the direction of a folded line is 86 mm and the intersection angle α1 to the horizontal plane is 25 degrees. The length dimension L2 of said evaporator 8-2 in the direction of a folded line is 104 mm and the intersection angle α2 to the evaporator 8-1 is 110 degrees. The length dimension L3 of said evaporator 8-3 in the direction of a folded line is 162 mm and the intersection angle α3 to the evaporator 8-1 is 50 degrees, the outer diameter of said cross-flow fan 2 is 106 mm. The length L4 of each set of said condensers 12 is 170 mm, the intersection angle α4 of the two sets of the condensers is 67 degrees. The vertical distance H1 between the end of said evaporator 8 and the axis of said cross-flow fan 2 is 58 mm, the horizontal distance H2 is 38 mm. The arc surface of the worm casing 3 is mainly composed of two sections of arc tangent surfaces of radius R1 being 80 mm and radius R2 being 135 mm, the vertical distance H3 between the origin of radius R1 and the axis of the cross-flow fan 2 is 19 mm, the horizontal distance H4 is 9 mm, the vertical distance H5 between the origin of radius R2 and the axis of the cross-flow fan 2 is −3 mm, the horizontal distance H6 is 29 mm. The vertical distance H7 between the origin of the wormn tongue 4 and the axis of the cross-flow fan 2 is 46 mm, and the horizontal distance H8 is 10 mm.

In the above technical solution, the wind inlet 11 is arranged in the front and the upper part of the face housing 7, and the wind outlet 5 is arranged in the lower part of the face housing 7.

The window-type of air-conditioner manufactured according to the above size is detected by using the method prescribed in the state standard GB/T7725-1996, its main performance indexes are: the noise is ≦46 dB (A), the energy-to-efficiency ratio is 2.35 W/W, the refrigerating capacity is 2300 W.

What is claimed is:

1. A window-type integrated air-conditioner, comprising a compressor (1), a cross-flow fan (2), an evaporator (8), a worm casing (3), a worm tongue (4), an outer housing (6), a face housing (7), a wind inlet (11), a wind outlet (5), condensers (12) and an axial flow fan (10), wherein the evaporator (8) has several sections connected from beginning to end and arranged in a folded form, said axial flow fan is arranged at the back ofthe condensers, said condensers are of two sets which when viewed from above are arranged in a V shape with an intersecting point of the condensers toward the inside of the room.

2. A window-type integrated air-conditioner according to claim 1, wherein the evaporator (8) having three sections, evaporator (8-1), evaporator (8-2) and evaporator (8-3).

3. A window-type integrated air-conditioner according to claim 2, wherein a length dimension L1 ofsaid evaporator (8-1) in the direction ofa folded line is 86–106 mm and the intersection angle α1 to a horizontal plane is 25–45 degrees, the length dimension L2 of said evaporator (8-2) in the direction of a folded line is 104–124 mm and the intersection angle α2 to said evaporator (8-1) is 110–130 degrees, and the length dimension L3 of said evaporator (8-3) in the direction of a folded line is 162–182 mm and the intersection angle α3 to said evaporator (8-1) is 50–70 degrees, an outer diameter of said cross-flow fan (2) is 106–146 mm.

4. A window-type integrated air-conditioner according to claim 3, wherein a length L4 of each set of said condensers (12) is 170–370 mm, the intersection angle α4 of the condensers is 67–107 degrees.

5. A window-type integrated air-conditioner according to claim 4, wherein a the vertical distance H1 between the origin of said worm casing (3) and an axis of said cross-flow fan (2) is 58–78 mm, the horizontal distance H2 is 38–58 mm, an arc surface of the worm casing (3) has two sections of arc tangent surfaces of radius R1 being 80–120 mm and radius R2 being 110–150 mm, the vertical distance H3 between the origin of radius R1 and the axis ofthe cross-flow fan (2) is 19–29 mm, the horizontal distance H4 is 9–19 mm, the vertical distance H5 between the origin of radius R2 and the axis of the cross-flow fan (2) is −3–7 mm, the horizontal distance H6 is 29–39 mm, thevertical distance H7 between the origin ofthe worm tongue (4) and the axis of the cross-flow fan (2) is 46–86 mm, and the horizontal distance H8 is 10–50 mm.

6. A window-type integrated air-conditioner according to claim 5, wherein the length dimension L1 of said evaporator (8-1) in the direction of a folded line is 91–101 mm and the intersection angle α1 to the horizontal plane is 30–40 degrees, the length dimension L2 of said evaporator (8-2) in the direction of a folded line is 109–119 mm and the intersection angle α2 to said evaporator (8-1) is 115–125 degrees, and the length dimension L3 of said evaporator (8-3) in the direction ofa folded line is 167–177 mm andthe intersection angle α3 to said evaporator (8-1) is 55–65 degrees, the outer diameter of said cross-flow fan (2) is 116–136 mm.

7. A window-type integrated air-conditioner according to claim 6, wherein the vertical distance H1 between the origin ofsaid worm casing (3) and the axis of said cross-flow fan (2) is 63–73 mm, the horizontal distance H2 is 43–53 mm, the arc surface ofthe worm casing (3) has two sections ofarc tangent surfaces of radius R1 being 90–110 mm and radius R2 being 120–140 mm, the vertical distance H3 between the origin of radius R1 and the axis of the cross-flowfan (2) is 21.5–26.5 mm, the horizontal distance H4 is 11.5–16.5 mm, thevertical distance H5 between the origin of radius R2 and the axis of the cross-flow fan (2) is −0.5–4.5 mm, the horizontal distance H6 is 31.5–36.5 mm, the vertical distance H7 between the origin of the worm tongue (4) and the axis of the cross-flow fan (2) is 56–76 mm, and the horizontal distance H8 is 20–40 mm.

8. A window-type integrated air-conditioner according to claim 7 wherein the length L4 ofeach setofsaid condensers (12) is 245–320 mm, theintersection angle α4 of the two sets of the condensers (12) is 77–97 degrees.

9. A window-type integrated air-conditioner according to claim 8, wherein the length dimension L1 of said evaporator (8-1) inthe direction of a folded line is 92.5–98.5 mm and the intersection angle α1 to the horizontal plane is 32.5–37.5 degrees, the length dimension L2 of said evaporator (8-2) in the direction of a folded line is 111.5–116.5 mm and the intersection angle α2 to said evaporator (8-1) is 117.5–122.5 degrees, and the length dimension L3 of said evaporator (8-3) in the direction of a folded line is 169.5–174.5 mm and the intersection angle α3 to said evaporator (8-1) is 57.5–62.5 degrees, the outer diameter of said cross-flow fan (2) is 121–131 mm.

10. A window-type integrated air-conditioner according to claim 9, wherein the vertical distance H1 between the origin of said worm casing (3) and the axis ofsaid cross-flow fan (2) is 65.5–70.5 mm, the horizontal distance H2 is 45.5–50.5 mm, the arc surface of the worm casing (3) has two sections of arc tangent surfaces of radius R1 being 95–105 mm and radius R2 being 125–135 mm, the vertical distance H3 between the origin of radius R1 and the axis of the cross-flow fan (2) is 23–25 mm, the horizontal distance H4 is 13–15 mm, the vertical distance H5 between the origin of radius R2 and the axis ofthe cross-flow fan (2) is 1–3 mm, the horizontal distance H6 is 33–35 mm, the vertical distance H7 between the origin ofthe worm tongue (4) and the axis ofthe cross-flow fan (2) is 61–71 mm, and the horizontal distance H8 is 25–35 mm.

11. A window-type integrated air-conditioner according to claim 10, wherein the length L4 of each set of said condensers (12) is 258–295 mm, the intersection angle $\alpha 4$ of the two sets of the condensers (12) is 82–92 degrees.

12. A window-type integrated air-conditioner according to any one of claims 1,2 or 11, wherein said wind inlets (11) are arranged in a front and an upper part of the face housing (7), the wind outlet (5) is arranged the lower part of the face housing (7).

* * * * *

UNITED STATES PATENT AND TRADEMARK OFFICE

CERTIFICATE OF CORRECTION

PATENT NO. : 6,314,748 B1
DATED : November 13, 2001
INVENTOR(S) : Jianghong Zhu et al.

It is certified that error appears in the above-identified patent and that said Letters Patent is hereby corrected as shown below:

Column 2,
Line 61, replace "Hi" with -- H1 --

Column 3,
Line 5, replace "worlml" with -- worm --
Line 42, replace "wonn" with -- worm --
Line 50, replace "wonrm" with -- worm --
Line 51, replace "wonn" with -- worm --

Column 4,
Line 29, replace "GB/T25" with -- GB/T7725 --

Column 5,
Line 24, replace "wormn" with -- worm --
Line 44, replace "ofthe" with -- of the --
Line 52, replace "ofsaid" with -- of said --
Line 53, replace "ofa" with -- of a --

Column 6,
Line 6, replace "ofthe" with -- of the --
Line 10, replace "thevertical" with -- the vertical --
Line 30, replace "ofthe" with -- of the --
Line 33, replace "flowfan" with -- flow fan --
Line 42, replace "ofeach setofsaid" with -- of each set of said --
Line 43, replace "theintersection" with -- the intersection --
Line 47, replace "inthe" with -- in the --
Line 59, replace "ofsaid" with -- of said --

UNITED STATES PATENT AND TRADEMARK OFFICE

CERTIFICATE OF CORRECTION

PATENT NO. : 6,314,748 B1
DATED : November 13, 2001
INVENTOR(S) : Jianghong Zhu et al.

It is certified that error appears in the above-identified patent and that said Letters Patent is hereby corrected as shown below:

Column 7,
Line 2, replace "ofthe" with -- of the --
Line 3, replace "ofthe" with -- of the --

Signed and Sealed this

Nineteenth Day of March, 2002

*Attest:*

*Attesting Officer*

JAMES E. ROGAN
*Director of the United States Patent and Trademark Office*